US008499888B2

(12) United States Patent
Fontaine

(10) Patent No.: US 8,499,888 B2
(45) Date of Patent: Aug. 6, 2013

(54) RACK ATTACHABLE TO SCAFFOLDING

(76) Inventor: Scott Fontaine, Seattle, WA (US)

( * ) Notice: Subject to any disclaimer, the term of this patent is extended or adjusted under 35 U.S.C. 154(b) by 0 days.

(21) Appl. No.: 13/104,712

(22) Filed: May 10, 2011

(65) Prior Publication Data

US 2011/0210088 A1 Sep. 1, 2011

Related U.S. Application Data

(63) Continuation of application No. 11/956,754, filed on Dec. 14, 2007, now abandoned.

(51) Int. Cl.
*E04G 5/00* (2006.01)

(52) U.S. Cl.
USPC .... 182/129; 211/113; 248/231.41; 248/228.3

(58) Field of Classification Search
USPC ..... 182/150, 129; 211/118, 113, 204, 211/172, 66; 248/496, 326, 340, 333, 231.41, 248/228.3, 616
See application file for complete search history.

(56) References Cited

U.S. PATENT DOCUMENTS 2,049,893 A * 8/1936 Chicoine ..... 248/228.3

* cited by examiner

*Primary Examiner* — Katherine Mitchell
*Assistant Examiner* — Daniel Cahn
(74) *Attorney, Agent, or Firm* — Garthwaite PLLC; Martin S. Garthwaite

(57) ABSTRACT

One or more rack modules may be semi-permanently attached to a deck to provide storage for material. Each rack module comprises a top horizontal member which may be adjusted in length to accommodate decks with different widths. A vertical member is attached to the top horizontal member; one or more horizontal arms extend out from the vertical member. One or more of the horizontal arms may be adjustable in length. Material may be stored on an arm or arms of a single rack module or may be disposed across multiple such arms, including across multiple such arms of multiple rack modules.

4 Claims, 10 Drawing Sheets

110
125
105
120
124
128
126
122
125
105
120
124
128
126

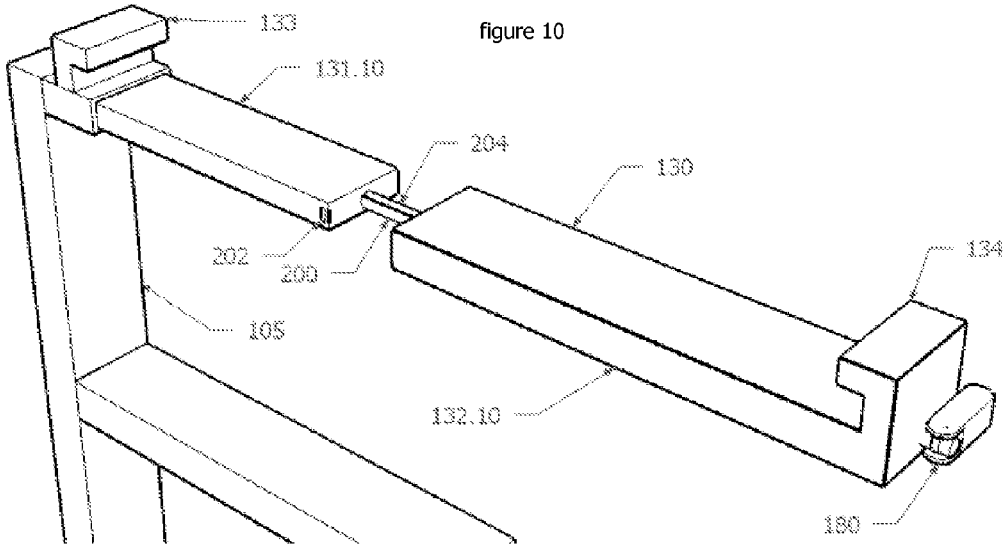
figure 10
figure 11
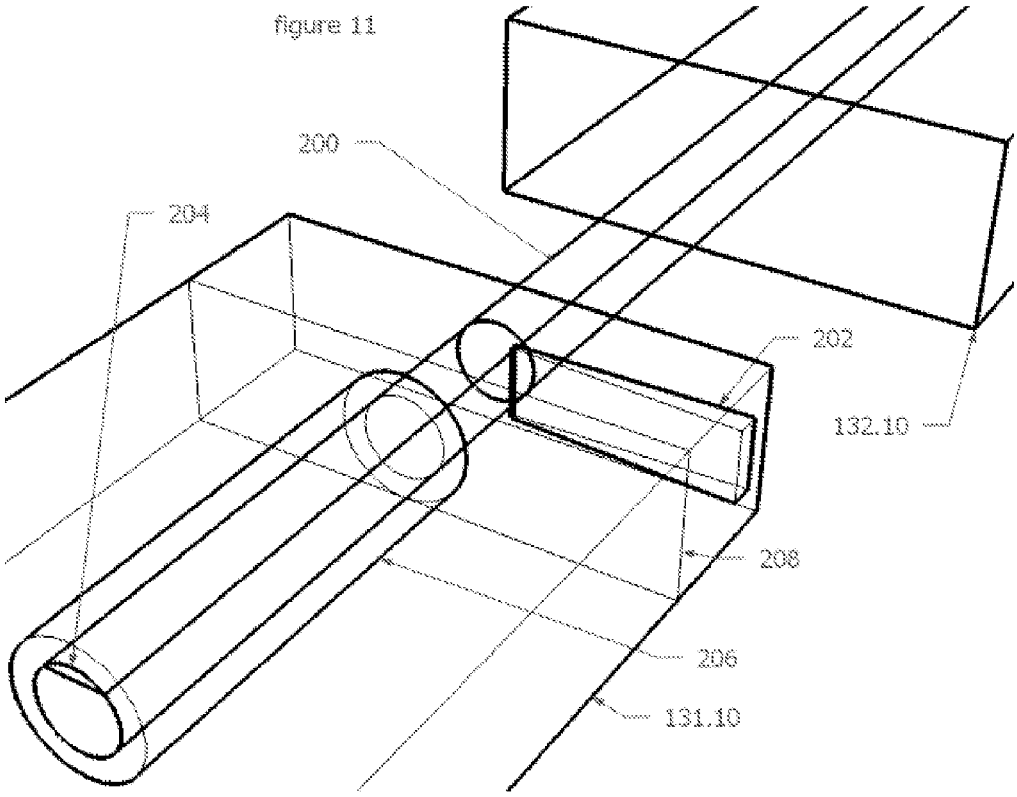

RACK ATTACHABLE TO SCAFFOLDING

This application claims priority to and is a continuation of application Ser. No. 11/956,754, filed Dec. 14, 2007 now abandoned which is incorporated herein in its entirety by this reference.

The invention relates generally to a rack which may be attached to a scaffolding system.

BACKGROUND

Many scaffolds comprise vertical risers and horizontal decks which may be raised and lowered on the vertical risers and/or which attach to fixed locations on one or more vertical risers. Workers often stand on a first deck while they use a second deck as a work surface as they shape and manipulate lumber, siding, pipe and tubing, wire, plastic sheeting, paint, and other material. Storing material on a deck may preclude using the deck for other purposes and may create an unsafe condition. As a storage area, a deck may be expensive, heavy, and over-engineered for the job.

The art has not demonstrated a structure or apparatus for a rack or shelf which may be semi-permanently attached to a deck, which is lighter in weight than a deck, and on which a variety of materials may be stored (semi-permanence as used in this disclosure means a structure or apparatus which is removable or which may be disengaged from a position or arrangement relative to another structure or apparatus without the use of tools).

SUMMARY

This summary is provided to introduce a selection of concepts in a simplified form that are further described below in the detailed description. This summary is not intended to identify key or essential features of the claimed subject matter, nor is it intended to be used to limit the scope of the claimed subject matter.

Generally stated, one or more rack modules may be semi-permanently attached to a deck to provide storage for material. Each rack module comprises a top horizontal member which may be adjusted in length to accommodate decks with different widths. A vertical member is attached to the top horizontal member; one or more horizontal arms extend out from the vertical member. One or more of the horizontal arms may be adjustable in length. Material may be stored on an arm or arms of a single rack module or may be disposed across multiple such arms, including across multiple such arms of multiple rack modules.

BRIEF DESCRIPTION OF THE DRAWINGS

FIG. 10 depicts a perspective view of an embodiment of a top horizontal member and attachment hardware.

FIG. 11 depicts a perspective wireframe view of detail of an embodiment of a top horizontal member.

DETAILED DESCRIPTION

The following detailed description refers to the accompanying drawings. The same reference numbers in different drawings identify the same or similar elements. If an element appears in more than one figure, and if the element is modified in a later figure relative to the earlier figure, then the element may be identified with the same element number, followed by a decimal representation of the later figure number.

Figure 1:
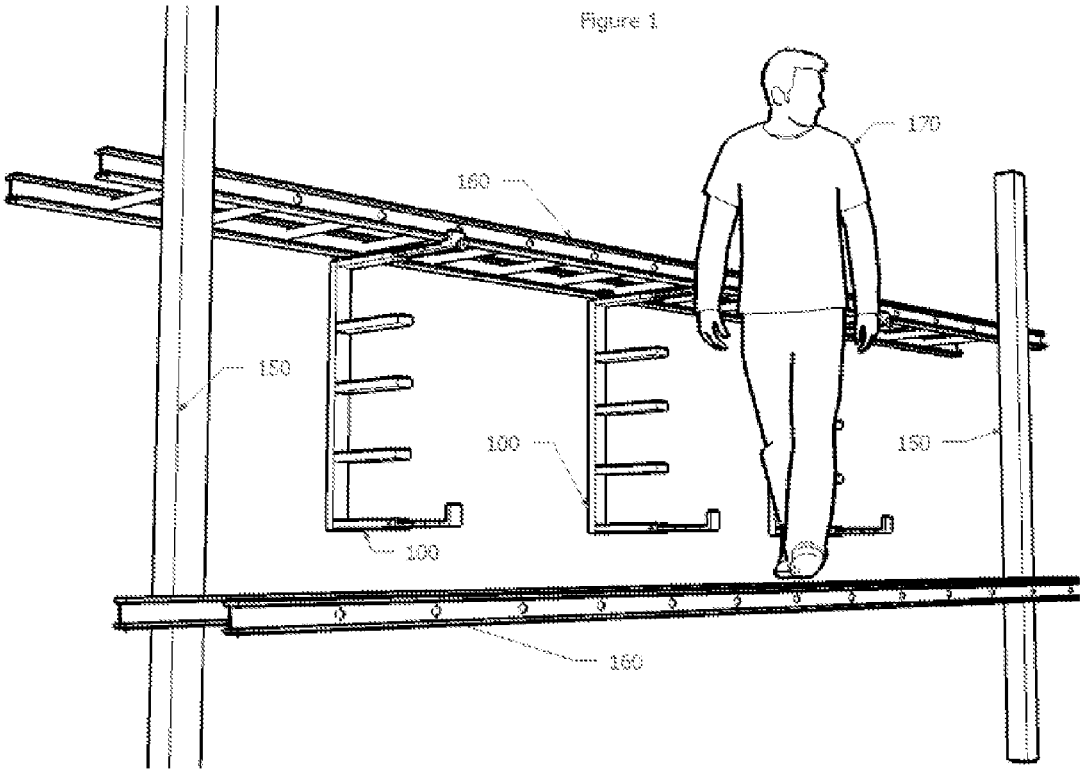
FIG. 1 depicts a scaffold system and three rack modules attached to a deck of a scaffold as well as a detail view of a portion of a rack module attaching to a portion of a deck.
Figure 1:
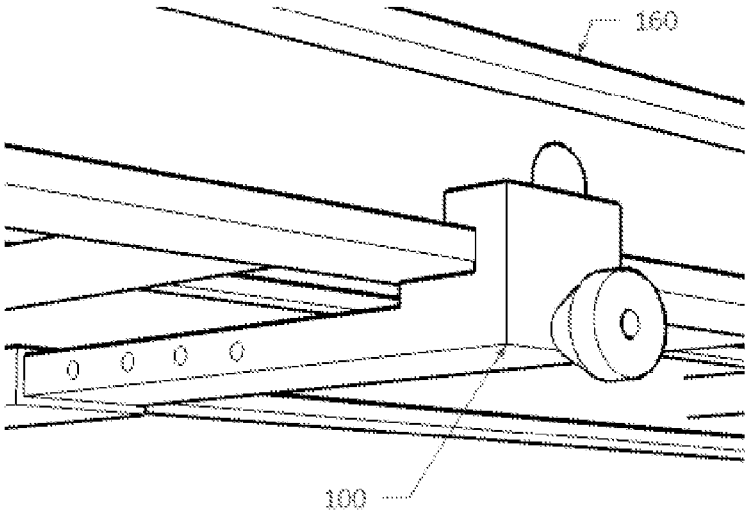

FIG. 1 depicts three rack modules 100, attached to the deck 160 of a scaffold system; the scaffold system is depicted in a simple form, comprising an upper and a lower deck 160 and two vertical risers 150. The scaffold system presented in the figures throughout are used as an example only and should not be understood as a limitation. A person 170 is depicted upon a deck 160. FIG. 1 also depicts a detail of a portion of the deck 160 fitting within a portion of the rack module 100, discussed further below.

Figure 2:
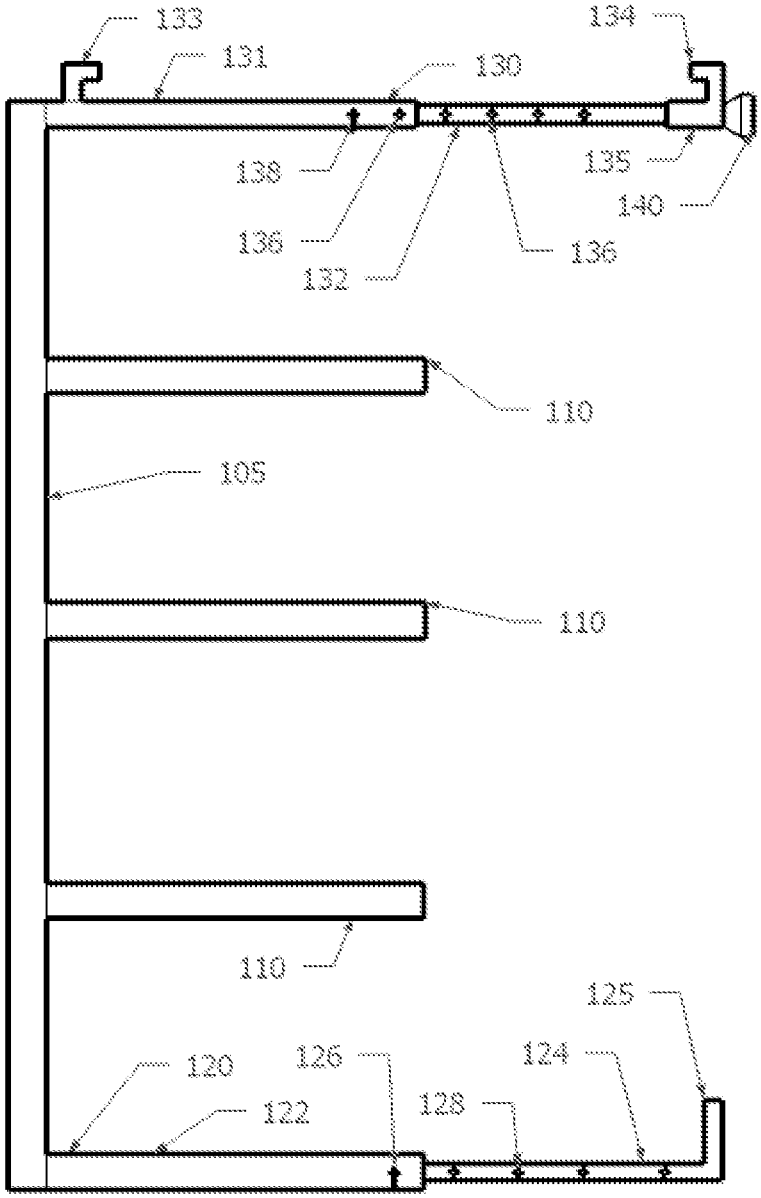
FIG. 2 depicts an elevation view of an embodiment of a rack module.

FIG. 2 depicts an elevation view of an embodiment of a rack module 100. The rack module is depicted as comprising a top horizontal member 130, a vertical member 105, three arm members of fixed length 110, and an arm member with adjustable length 120. The top horizontal member 130 further comprises a first clasp 133, a first top portion 131, an end cap 135 comprising a second clasp 134, a middle top portion 132, an optional pin means 138 (discussed further herein), and optional holes or equivalent structures 136 in the first top portion 131 and the middle top portion 132. Attached to the end cap 135 is optional attachment hardware 140. The first clasp 133 is depicted as being located a distance from the vertical member 105, though in any embodiment the first clasp may be attached to the top of the vertical member 105. Other embodiments of the top horizontal member 130 are discussed further herein. This disclosure refers to adjusting or changing the length or overall length of the top horizontal member 130; it should be understood herein that this refers to adjusting the distance between the first and second clasps 133 and 134. The vertical member 105 may be lengthened, using means similar to those described herein with respect to the horizontal top member 130 and/or the adjustable arm 120.

The clasps 133 and 134 are generally depicted in the figures as being composed of rectangular components; in alternative embodiments, one or another of the clasps 133 and 134 may be rods of a circular, rectangular, or other regular or irregular cross section with an absolute distance across the longest length of the cross-section (such as the diameter of a circle or the hypotenuse bisecting a rectangle into two triangular sections) being sized to fit in a location such as within an opening in the side of a deck 160, such as the generally tubular horizontal braces which are found on many scaffold decks, or above the flange which is found on many decks (such a flange being depicted in the detail view in FIG. 1). In another embodiment, the deck 160 and/or the flange on a deck may comprise a notch into which a suitably formed clasp may be fitted.

The figures also depict the various members and components of the rack 100 as generally being composed of components with rectangular cross sections; in alternative embodiments, these members and components may have circular, triangular, or other regular or irregular cross sections.

The arm member with adjustable length 120 in FIG. 2 is depicted as comprising a first arm portion 122 and a second arm portion 124. Optional holes 128 are depicted in the first arm portion 122 and the second arm portion 124; also labeled in FIG. 2 is optional pin means 126 (discussed further herein). A foot 125 is also depicted.

Figure 3:
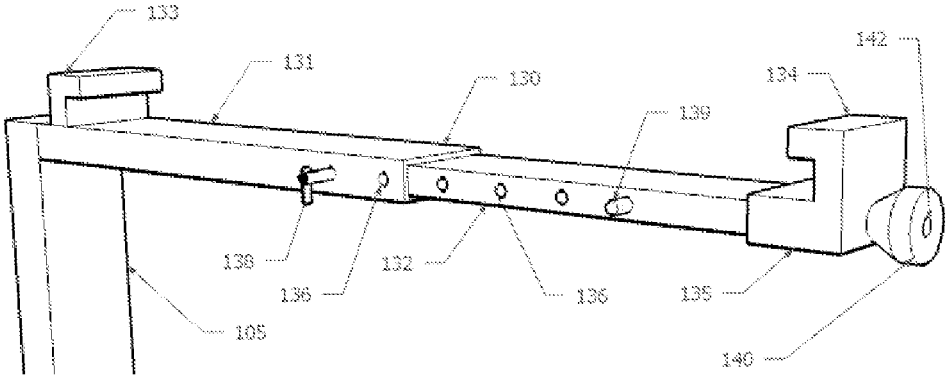
FIG. 3 depicts a perspective view of an embodiment of a top horizontal member.

FIG. 3 depicts a perspective view of an embodiment of a top horizontal member. In addition to the features described with respect to FIG. 2, FIG. 3 also shows a spring-loaded pin 139 variation of the optional pin means (discussed further below) and a closer partial view of a self-retaining pin 138. The spring-loaded pin 139 is shown protruding from one hole 136 in the middle top portion 132; additional spring-loaded pins 139 may be located in the other holes 136 and may protrude through the holes 136 in the first top portion 131 (in which embodiment the self-retaining pin 138 may not be present). FIG. 3 also shows the end of a rod 142 and that the attachment hardware 140 in this embodiment comprises a knob.

Figure 4:
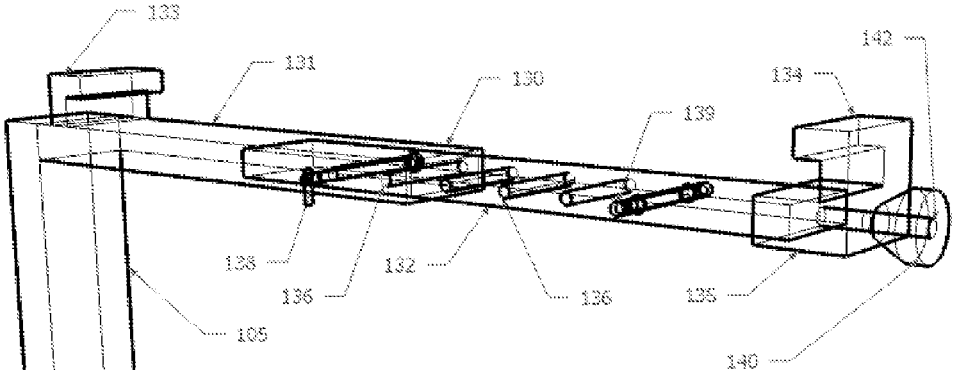
FIG. 4 depicts a perspective wireframe view of an embodiment of a top horizontal member.

FIG. 4 depicts a perspective wireframe view of the embodiment of a top horizontal member 130 depicted in FIG. 3. In addition to the features described with respect to FIG. 3, FIG. 4 also shows that the first top portion 131 and the middle top portion 132 may overlap. In these figures, the middle top portion 132 is depicted as fitting within the interior cross-section of the first top portion 131; in an alternative embodiment (see, for example, FIGS. 10 and 11), the first top portion 131 may fit within the interior cross-section of the middle top portion 132. FIG. 4 also shows that holes 136 in the first top portion 131 and the middle top portion 132 may lie on a common plane and that the holes 136 in the first top portion 131 and the middle top portion 132 may be aligned along common central axis when the middle and the first arm portions are overlapped. FIG. 4 also shows the pin means 138 and 139 (discussed further herein) extending through the first top portion 131 and/or the middle top portion 132.

FIG. 4 also shows end cap 135 overlapping the middle top portion 132 and that the rod 142 extends from at least the middle top portion 132 to the attachment hardware 140. The end cap 135 may be a component separate from the middle top portion 132, as depicted in FIG. 4, or may be a permanent part of the middle top portion 132.

Figure 5:
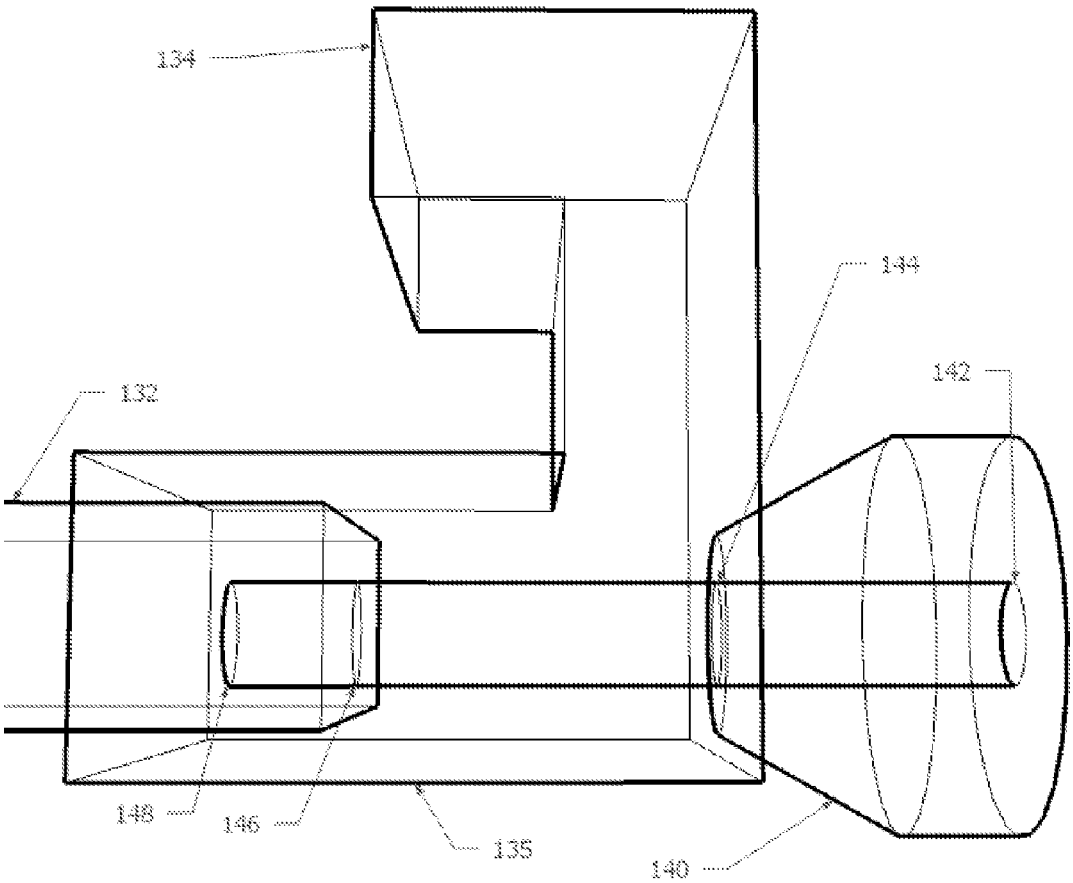
FIG. 5 depicts a perspective wireframe view of an embodiment of attachment hardware on a top horizontal member.

FIG. 5 depicts a perspective wireframe view of an embodiment of an end cap 135 and attachment hardware 140 on a top horizontal member. In addition to the features shown in other figures, this figure depicts the rod 142 connecting to the middle top portion 132 at location 146. All or some of the rod 142 may be threaded. The portion between number 146 and number 148 (extending into the middle top portion 132) may further comprise a female threaded receptacle for receiving the rod, in which case the rod may be permanently (permanence indicating that it may be removable, but only through the use of tools) attached to the attachment hardware knob 140. In another embodiment, the portion between 144 and 142 (extending into the attachment hardware 140) may further comprise a female threaded receptacle for receiving the rod, in which case the rod may be permanently attached to the middle top portion 132.

Figure 6:
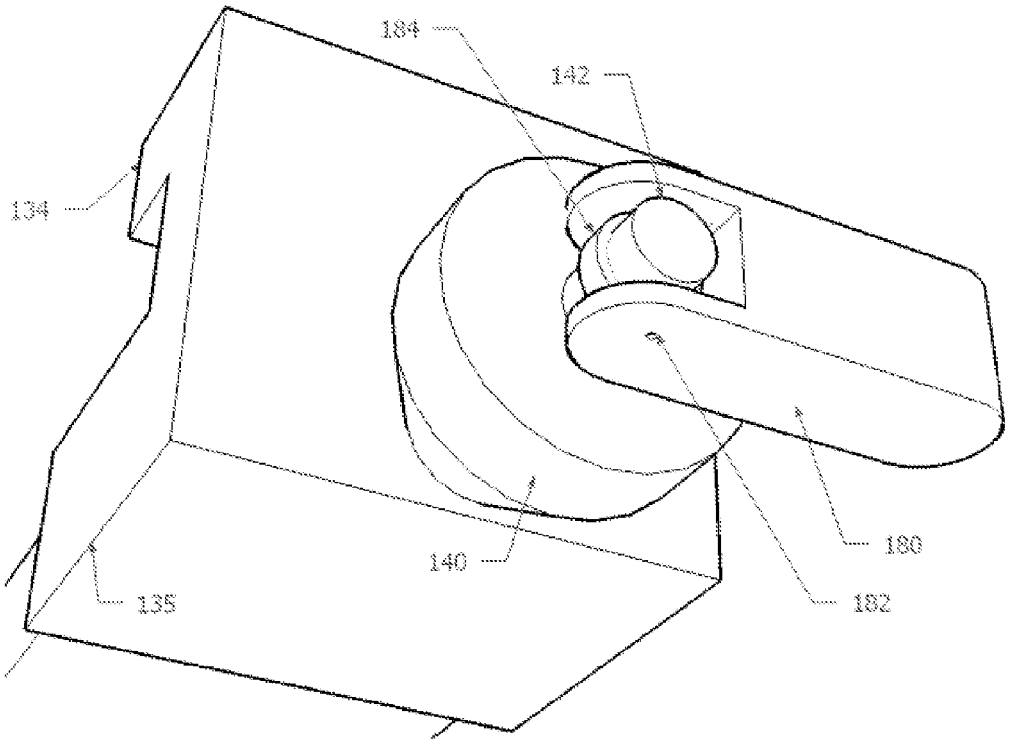
FIG. 6 depicts a perspective view of an embodiment of attachment hardware on a top horizontal member.

FIG. 6 depicts a perspective view of an embodiment of an end cap 135 and attachment hardware 140 on a top horizontal member 130. In addition to the features shown in other figures, this figure depicts a cam lever arm 180. The cam lever arm 180 comprises an axis 182 which is either off-center in a circle or which is off-center of or at the center (between the foci) of a non-circular ellipse or another geometric form which provides a similar function. The ellipse is connected to a lever arm and may be rotated around the axis 182. The cam lever arm 180 may further comprise a collar 184 for attachment and/or bonding to a rod, such as rod 142. The collar may be threaded or not. Moving the lever arm rotates the ellipse and changes the distance between the axis 182 and the perimeter of the ellipse, which perimeter contacts a surface, such as the end cap 135 or the attachment hardware 140, either tightening or loosing the resulting connection.

FIG. 6 depicts both a cam lever arm 180 and attachment hardware 140. In an embodiment, the attachment hardware 140 may not be present, in which case the cam lever arm 180 may butt against the end cap 135 (see, for example, FIG. 10). The cam lever arm 180 and the attachment hardware 140 may both be referred to generally as "attachment hardware."

In the example shown in FIG. 6, with the lever arm 180 in a loosened position (approximately perpendicular to the position shown in FIG. 6), the gross length of the top horizontal member 130 may be adjusted and the claps 133 and 134 located in the desired position along a deck 160, as discussed herein. The lever arm 180 may then be moved to a tightened position (as shown in FIG. 6), thereby tightening the end cap 135 against the middle top portion 132 and/or the first top portion 131 and securing the rack module 100 to the deck 160 through compression and friction.

Figure 7:
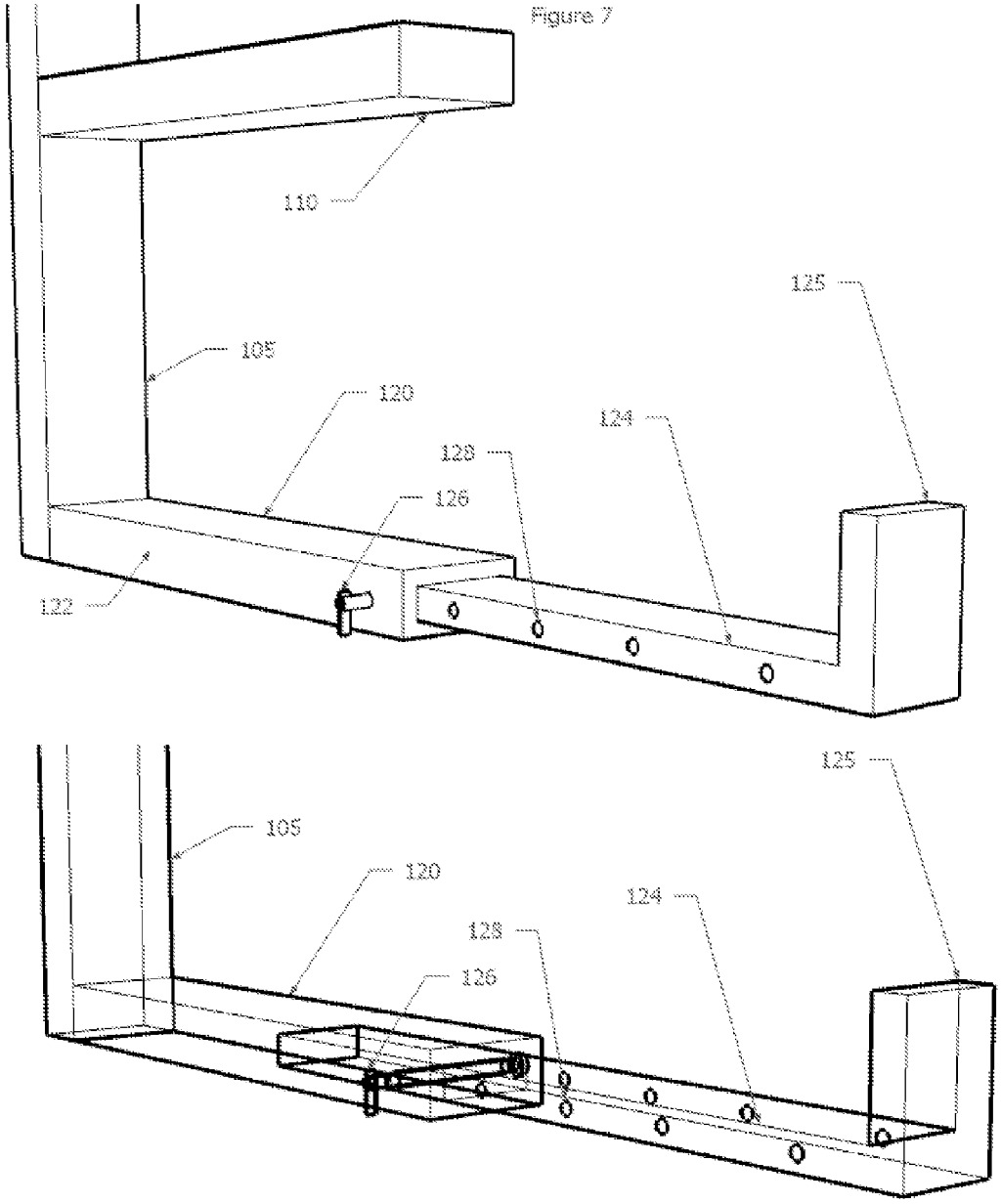
FIG. 7 depicts a perspective view of an adjustable horizontal arm and the same perspective in a wireframe view.

FIG. 7 depicts a perspective view of an embodiment of an arm member with adjustable length 120 and a wireframe view of the same image. In addition to the features shown in other figures, this figure shows a closer view of an embodiment of the pin means 126 (this particular embodiment being similar to the self-retaining pin 138) and the wireframe view shows that the first arm portion 122 and a second arm portion 124 may overlap.

Figure 8:
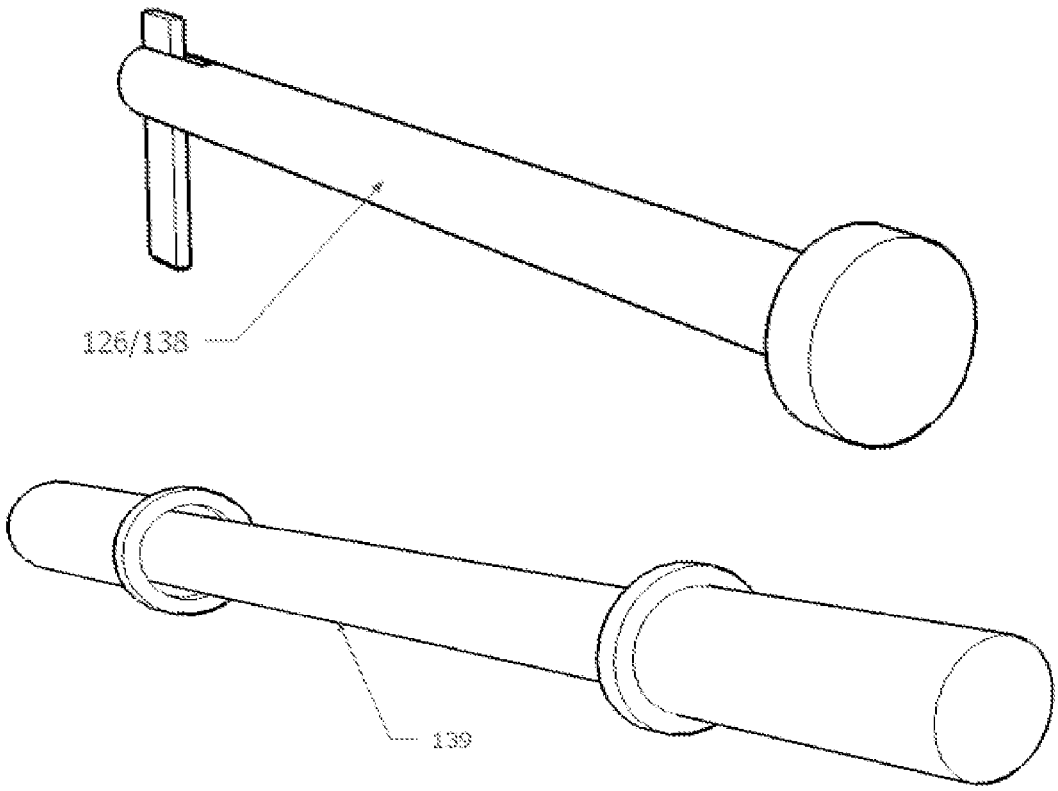
FIG. 8 depicts embodiments of pin means.
Figure 9:
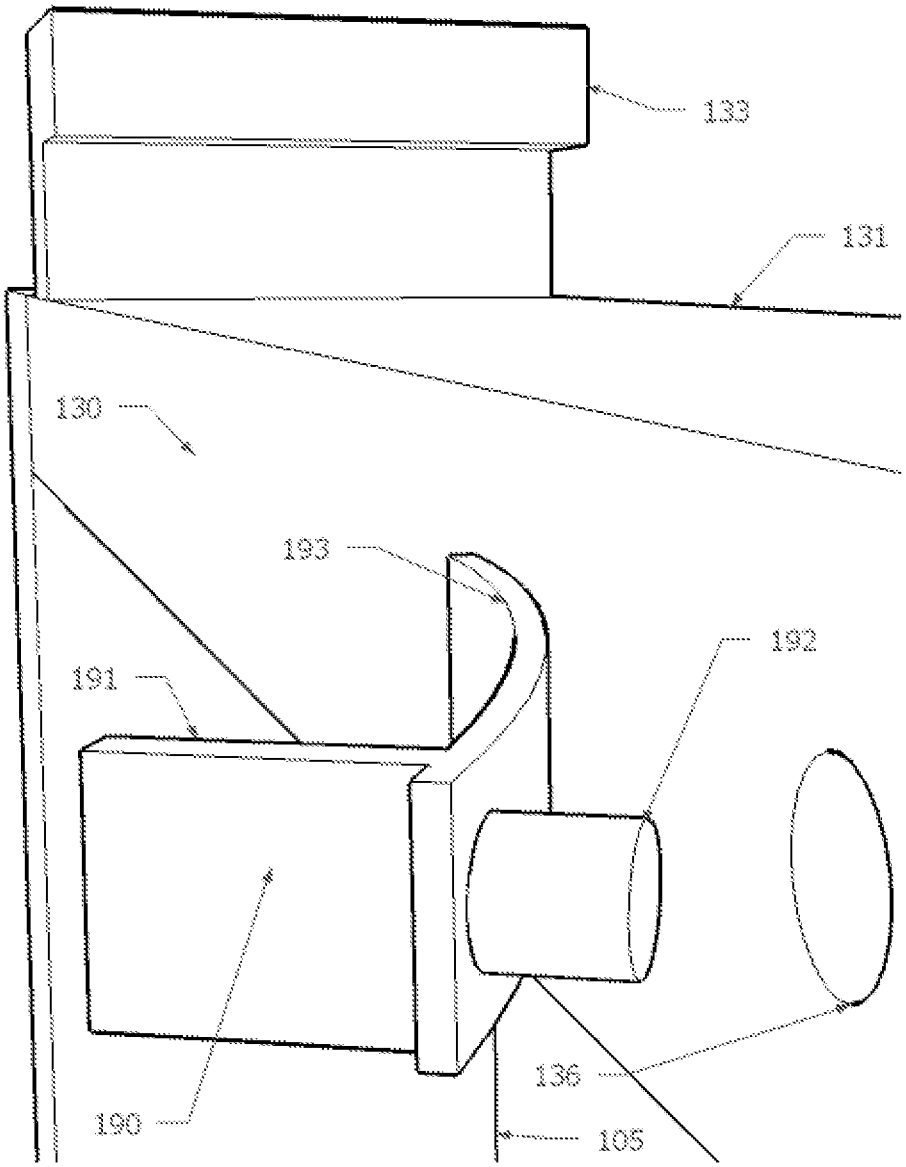
FIG. 9 depicts an embodiment of pin means or an embodiment of a pawl.

FIGS. 8 and 9 depict alternative embodiments of the pin means 126/138 and 139. Pin means herein refers to a structure or apparatus comprising a rod, pawl, or similar structure which may be engaged with a notch, hole, or other opening in and/or through a first and/or a second structure, which engagement causes the first and/or second structures to be immobilized relative to one another and/or relative to a third structure. The rod, pawl, or similar structure may be attached to the first, second, or third structure or to no structure. The embodiments of pin means shown in this disclosure are for example only.

The embodiment of pin means numbered 126 or 138 is generally referred to herein as a self-retaining pin. Such self-retaining pins or similar apparatus may comprise a rod, an end cap, nut, flange or similar structure at one end of the rod, and a groove in the other end of the rod, in which groove a rectangular or similar structure may be located. The rectangular or similar structure may comprise a closed channel (not open to the perimeter of the rectangle) through which an axle may pass, the axle spanning the groove in the end of the rod. The rectangular or similar structure may be free to slide up and down, relative to the axle, as well as to rotate around the axle. The rectangular or similar structure may be manipulated to lie generally along a horizontal axis, relative to the central axis of the self-retaining pin, whereupon the pin may be passed through an opening or set of openings or channel, following which the rectangular or similar structure may be manipulated to lie generally perpendicular relative to the central axis of the self-retaining pin. When forces act on the self-retaining pin which might otherwise act to push the pin back through the opening, the rectangular or similar structure will block the passage of the pin. The rectangular or similar structure is analogous to a cotter pin passed through a hole in the end of a bolt.

Pin means 139 in FIG. 8 depicts a spring-loaded pin. The spring-loaded pin comprises a central rod. Within or at both ends of the rod one or more springs may be found. The springs may exert force, generally outward along the central axis of the rod, upon end caps or end rods. There may be retainers, such as a flange, to prevent the end caps or end rods from being ejected by the springs. In operation, the end caps or end rods may be compressed against the springs, resulting in an overall shortening of the length of the spring-loaded pin 139. When the spring-loaded pin and or other structures are at the desired location, the compressed end caps or end rods may be released, resulting in an overall lengthening of the spring-loaded pin 139. The lengthened spring-loaded pin may engage with a first and/or second structure, as discussed above.

FIG. 9 depicts a third embodiment of pin means 190. In this embodiment, a leaf spring 193 is attached at one end to the first top portion 131. At the other end, a rod, tooth, or similar structure 192 is located in a position where it will engage with a hole, notch or similar 136. A tab, ring, or similar structure or apparatus 191 may be provided which may allow a person or another structure or apparatus to bend the leaf spring 193 back to thereby remove the tooth 192 from its engaged position. The pin means 190 may be considered equivalent to a pawl which may also be part of a ratchet apparatus. In the example depicted in FIG. 9, the holes 136 in the first top portion 131 and the middle top portion 132 would be aligned along a common central axis, the pin means 190 would be released, and the rod or tooth 192 would pass through the aligned holes, preventing the first top portion 131 and the middle top portion 132 from moving relative to each other.

FIG. 10 depicts an alternative embodiment in which the first top portion 131.10 fits within the interior cross-section of the middle top portion 132.10 (the figure shows these portions in a non-overlapping configuration for the sake of clarity). This figure also depicts an alternative apparatus embodiment for adjusting the overall length of the top horizontal member 130. In this alternative, a rod 200 passes through the length of the middle top portion 132.10 and into the first top portion 131.10. The rod may be notched 204 along a section plane of its length. In this view, only the section plane and not individual notches are shown. The rod 200 may be rotated about its central axis, for example by rotating the cam lever arm 180, to engage a pawl (which may be a spring-loaded pawl) 202 in the notches 204. With the notches 204 engaged in the pawl 202, the middle top portion 132.10 and rod 200 may be pushed toward the vertical member 105, reducing the overall length of the top horizontal member 130, with the pawl 202 engaging successive notches. The length may be shortened further and the clasps 133 and 134 tightened against the deck 160, by rotating the cam lever arm 180 about its axle, as discussed above. The top horizontal member 130 may then be loosened by releasing the cam lever arm 180 and/or by rotating the rod 200 about its central axis to release the notches 204 from the pawl 202, freeing the middle top portion 132.10 to be pulled away from the vertical member 105.

FIG. 11 shows a wireframe view of the preceding figure, from a different vantage. In this figure, in addition to the features shown elsewhere, it is easier to see the section plane in which the notches 204 may occur. In this figure the gross features of a representative pawl 202 are shown on the interior of the first top portion 131.10 (a spring, in the case of a spring-loaded pawl 202, is not shown). In this view, the pawl 202 is not engaged with the notches 204. In this figure, a compression spring is represented by a tube as feature 206, as well as a retainer wall (or equivalent structure) 208 for retaining the compression spring 206; a flange or similar on the end of the rod 200 to retain the spring 206 at that end is not shown. The figure illustrates one means through which a compression spring 206 may be incorporated into the top horizontal member 130, serving to drive the first top portion 131.10 and the middle top portion 132.10 toward one another (which may assist a person in placement of a rack 100 in relation to a deck 160). It should be understood that many different arrangements of a spring, piston, or similar may be employed to provide a similar function.

Figure 12:
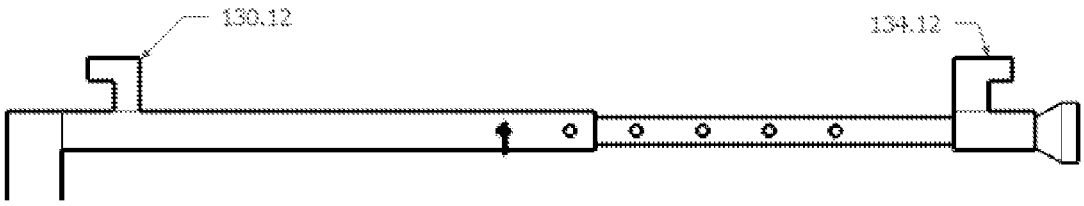
FIG. 12 depicts an elevation view of an embodiment of a top horizontal member.

FIG. 12 shows an alternative embodiment in which the clasps 130.12 and 134.12 define openings which face the opposite way from that shown elsewhere, to attach to a flange or similar structure which may be present on the interior walls of a deck 160. It would be understood that, in such an embodiment, the top horizontal member 130 would be shortened to be released from the deck 160 and lengthened to be attached to the deck 160.

There exist a number of different embodiments which would allow the length of the top horizontal member 130 or equivalent structure to be adjusted in a gross fashion to a length at which a attachment hardware 140, cam lever arm 180 or equivalent may be used to make a final length adjustment and to secure the rack module 100 to a deck 160 through application of pressure and friction.

As presented in the figures, the gross length of the top horizontal member 130 may be adjusted by changing the amount of overlap between the first top portion 131 and the middle top portion 132, such as through manipulation of the pin means 138 and/or 139 and by pushing or pulling the first top portion 131 and the middle top portion 132 together or apart to change the amount of overlap. Before or after adjusting the gross length of the top horizontal member 130, the first clasp 133 may be positioned on the deck 160, a first portion of the deck 160 being positioned within the opening defined by the first clasp 133. If it is not already, the end cap 135 may be loosened and a second portion of the deck 160 (the second portion being on the opposite side from the first portion, the first and second deck portions being defined only by their positions relative to one another) may be positioned within the opening defined by the second clasp 134. The end cap 135 may then be tightened onto the middle top portion 132 using the attachment hardware 140 or 180, such as by rotating the attachment hardware knob 140, which rotation may cause the rod to be threaded into the female threaded receptacle (which female threaded receptacle may be located in either the middle top portion 132 or the attachment hardware knob 140), or by moving the cam lever arm 180 into a tightened position. Reversing the rotation may loosen the end cap 135. The attachment hardware 140 or 180 acts to fine-tune the overall length of the top horizontal member 130, allowing the rack 100 to slide back and forth along a deck 160 when loose and, when tight, snugging the clasps 133 and 134 against the deck 160 and holding the rack 100 in place through pressure and friction.

The figures discussed above present example means to adjust the overall length of the top horizontal member and through which means a rack may be attached or secured to a deck 160 through pressure and friction. All alternative embodiments are not presented, there being many equivalent structures and apparatus which could provide the same function. Many of the means described above include a first means to adjust the gross length of the top horizontal member 130, such as manipulate of the pin means and by changing the amount of overlap between the first and middle top portions, and a second means to fine-tune or make a final adjustment to the length of the top horizontal member 130 and to releaseably secure the finally adjusted length, thereby securing the rack 100 to a deck 160 through pressure and friction. The various means to adjust the overall length of the top horizontal member may be combined in other combinations to achieve the same function of securing the rack 100 to a deck 160 through pressure and friction.

The means of adjusting the overall length of the top horizontal member 130 to attach or secure a rack 100 to a deck 160 may comprise any apparatus which changes the overall length of the top horizontal member 130 and which may be manipulated between at least two settings, one tight, the other loose. The tight setting should offer resistance to being loosened, to avoid unintended disengagement of the rack 100 from a deck 160 while allowing a person to reset the apparatus into the loose setting, preferably without the use of tools. The attachment hardware 140 and cam lever arm 180 depicted herein are provided as examples, not as exclusive embodiments of such means.

Another example of such means may comprise two rods connected by a joint. The two rods may be connected at their far ends to two points. The two points may be restrained in their allowed motion by a frame, such as by a first and a second overlapping member (much as is shown in the figures), which allows the points to move toward or away from each other along a line. The distance between the points along the line may be changed by displacing the joint up or down, with the horizontal configuration (when the rods and the joint lie on a common horizontal plane) being the configuration with maximum distance between the points. If the two points are in contact with objects which are a distance apart which is slightly shorter than the maximum allowed distance between the points and if the rods or other components provide a degree of compressibility and if the joint is allowed to move further on a first side of the horizontal plane than on a second side (movement into the second side being restrained by a block, by other geometry of the apparatus, or by similar means), then a graph of the compression pressure between the points would roughly follow a curve, with peak pressure occurring at the horizontal configuration, the least pressure (potentially zero or even negative pressure) occurring when the joint is displaced onto the first side (which allows the furthest movement from the horizontal configuration) and an intermediate positive pressure level occurring when the joint is displaced into the second side. The geometry of such an apparatus typically precludes the device coming to a rest in the horizontal configuration, favoring resting states on the first side or the second side.

Such an apparatus would meet the criteria of providing a first loose setting (when the joint is displaced onto the first side) and a second tight setting (when the joint is displaced onto the second side). The energy required to move the apparatus from the tight to the loose setting would be related to the distance the joint is allowed to be displaced onto the second side relative to the horizontal configuration and the compressibility of the rods or other components. Such an apparatus may be used instead of the cam lever arm 180 or attachment hardware 140 discussed above. Such an apparatus may be combined with another apparatus which other apparatus may adjust the gross distance between the two points, while the apparatus performs a final adjustment of the distance between the two points and non-permanently locks the points into place, such as by displacement of the joint into the second side. Other alternative means may include apparatuses such as buckles, including jointed buckles and/or buckles with straps and/or buckles with a ratchet-like action, which may be used to draw a first and a second component together under pressure.

The rack 100 may be fabricated from a variety of materials, including, for example and without limitation, aluminum, iron, steel, stainless steel, nickel, copper, magnesium, titanium, bronze, alloys thereof, galvanized metal, fiberglass, carbon fiber, plastic, wood, and fiberboard, to name but a few examples.

The invention claimed is:

1. A rack apparatus for attachment to a scaffold deck, the rack apparatus comprising:

a horizontally oriented scaffold deck;

a horizontal top member secured to the horizontally oriented scaffold deck by first components which adjust a first gross length of the horizontal top member and second components which adjust a second finely adjusted length of the horizontal top member, thereby bracing the horizontal top member to the horizontally oriented scaffold deck so that the deck is directly above the horizontal member;

a top end of a vertical member directly attached to the horizontal top member, the vertical member extending vertically when in use; and at least one horizontal arm directly attached to a bottom end of the vertical member below the horizontal top member, the at least one horizontal arm comprising a means to adjust a length of said horizontal arm;

the first components comprise:

a first tubular top member comprising: a first clasp sized to accommodate a portion of a first side of the scaffold deck; and a middle top portion, the first components include a removable pin that passes through alignable holes respectively located in the first tubular top portion and the middle top portion to adjust the first gross length;

the second components comprise:

a tubular end-cap portion comprising a second clasp sized to accommodate a portion of a second side of the scaffold deck opposite the first side of the scaffold deck, the tubular end-cap portion being separable from the middle top portion; and a knob which secures the tubular end-cap portion to the first tubular top portion via the middle top portion, the rod comprising a male threaded portion which is threaded into a threaded female receptacle in the knob and a threaded female receptacle in the middle top portion by extending through the tubular end-cap portion to adjust the second finely adjusted length;

the first tubular and middle top portions overlap and the middle top and tubular end-cap portions overlap so that the middle top portion slideably fits within the first tubular top portion and slideably fits within the tubular end-cap portion.

2. The rack according to claim 1, wherein the at least one horizontal arm comprises two overlapping portion which overlap one another, one of the two overlapping portions of the at least one horizontal arm is sized to fit within the other of the two overlapping portions of the at least one horizontal arm.

3. The rack according to claim 2, where the overlapping portions of the at least one horizontal arm comprise at least one hole in each respective overlapping portion of the at least one horizontal arm, the respective holes of the at least one horizontal arm can be aligned along a common axis when the overlapping portions of the at least one horizontal arm are overlapped, the at least one horizontal arm further comprising a second pin extending through the common axis of a pair of aligned holes, the second pin thereby preventing the overlapping portions of the at least one horizontal arm from sliding relative to one another.

4. The rack according to claim 1, wherein the vertical member and the horizontal arm form an open geometry.

* * * * *